US005450495A

United States Patent [19]

Goldfarb

[11] Patent Number: 5,450,495

[45] Date of Patent: Sep. 12, 1995

[54] LOUDSPEAKER SYSTEM

[75] Inventor: Barry S. Goldfarb, Deland, Fla.

[73] Assignee: BSG Laboratories. Inc., Deland, Fla.

[21] Appl. No.: 181,808

[22] Filed: Jan. 18, 1994

[51] Int. Cl.[6] ..... H04R 1/02

[52] U.S. Cl. ..... 381/89; 181/196; 181/197

[58] Field of Search ..... 381/89, 154, 159; 181/153, 156, 189, 190, 196, 197, 199

[56] References Cited

U.S. PATENT DOCUMENTS

| | | | |
|---|---|---|---|
| 3,818,138 | 6/1974 | Sperrazza | 181/89 |
| 3,945,461 | 3/1976 | Robinson | 181/153 |
| 4,753,317 | 6/1988 | Flanders | 181/144 |
| 4,756,382 | 7/1988 | Hudson, III | 181/153 |
| 4,905,788 | 3/1990 | Lanternier | 181/144 |
| 5,073,945 | 12/1991 | Kageyama et al. | 381/159 |
| 5,082,084 | 1/1992 | Ye-Ming | 181/153 |

*Primary Examiner*—Edward L. Coles, Sr.
*Assistant Examiner*—Jerome Grant, II
*Attorney, Agent, or Firm*—Quarles & Brady

[57] ABSTRACT

A loudspeaker apparatus includes an elongated hollow tube having two open ends, which tube may be a rigid or telescoping tube, and has a wide range speaker mounted at each end of the hollow tube. A pair of deflector surfaces may be flat, polymer surfaces mounted to a base and are positioned at an angle facing each speaker at each end of the tube for deflecting the sound waves emanating from each speaker in accordance with the positioning of the tube. The tube may also have a tuned port formed into the side of the tube and connected to an arcuate passageway built into the hollow portion of the inside of the tube for producing a bass resonance from the backwaves of both speakers.

2 Claims, 1 Drawing Sheet

LOUDSPEAKER SYSTEM

BACKGROUND OF THE INVENTION

The present invention relates to a loudspeaker system and especially to a loudspeaker system using an elongated hollow tube having wide range speakers mounted in each end thereof for emanating sounds from each of the tube.

The loudspeaker tube system in accordance with the present invention will produce a stereophonic sound or a dual monophonic sound system which is self-contained in a single length of pipe or tubing with a full range loudspeaker at either end of the length of the pipe. The design simplifies the otherwise cumbersome loudspeaker components normally associated with higher quality sound systems by having a single module that does all of the work for the system.

In the past, stereophonic sound systems of high quality sound reproductions have been incorporated into two or more loudspeaker enclosures. These enclosures employ more than one driver inside the loudspeaker box and many employ a woofer, midrange, and a tweeter driver in at least two enclosures separated by distance between the two speakers to achieve a sound stage. Sometimes a subwoofer is used to handle bass frequencies below 100 Hz.

The present invention is a full range loudspeaker system which maximizes the bass frequencies in the subwoofer range and isobaric configurations set the two drivers out of phase with each other in the tube to increase the lower frequency sound pressure levels while minimizing box size requirements. This technique is commonly called "push-pull" because one loudspeaker pushes while the other pulls using the air pressure in the enclosure. This technique has been successfully used in low frequency units in the past but has had severe limitations in full range loudspeakers. One problem in full range loudspeakers has been the phase shift in a full range loudspeaker system, particularly where a stereophonic or discrete two channel signals are introduced. The phase must be correct or the sound stage will be off-center. In addition, one speaker will seem to have more bass than the other speaker, which will sometimes appear tinny or thin. An advantage of the present system using a length of tubing is that a discrete stereo signal can be placed in phase to each driver by having one driver face the furthest distance from the other inside a single pipe. The signal from channel one will cause the associated driver to push out thereby rarifying the air within the container and pulling the opposing driver along while doubling the SPL and bass frequency response. The second driver, which receives a second signal, will electrically be pulling in the opposite direction to that of the acoustic action caused by the first signal reaction. Thus, a dual opposing signal or extended stereo signal can create a push-pull affect on a full range loudspeaker system if that system is contained in a single unit where the drivers are set to the furthest point within the unit away from each other, in phase electrically, and where the enclosure is equal to a minimum of twice the length of the radius of one of the drivers and assuming both drivers are of equal character, size, shape, and general electrically acoustical response to one another.

There have also been small stereophonic systems in the past but the advantage of the cylindrical tube is that it is a singular and small pipe with a length of five inches or more, can put out more bass with more sound pressure level, and more full range frequency response with more clarity and with more perceived volume than systems three to four times its size and weight.

In the stereophonic full range mode, the sound stage can be easily adjusted using simple mechanical controls or walls to reflect the sound in the direction you would have it to go. The width of the sound stage can be spread out or brought in closer depending upon how far out you choose to place the simple deflection walls.

Another way to create a sound stage which incorporates an acoustic center field image is to cut a hole into the center of the pipe equal in size to at least half the radius of either of the two drivers and force a length of pipe, at least the length of the diameter of the hole, into the hole, closing off all air from escaping outside the center hole. The interaction between the two stereo signals using standard tuning procedures, like a helmholtz or a small theile tuned port, will produce the third product of sound which results from the tuned port or an acoustical center field.

In a dual mono-mode, where each of the two speakers are driven by a monophonic signal, a better bass signal can be produced and two pipes can be used driven by the same monophonic signal to produce a bigger, louder sound capability. In the dual monophonic configuration each driver can be wired in standard phase, which produces a single point source full range uniform response, or out-of-phase using the isobaric configuration. In this configuration, the bass response will increase below 150 Hz but the length of pipe needs to be cut to be equal to at least the length of one of the drivers radius. For instance, if the driver is 4" around, the length between the two drivers would be approximately 4" long. The disadvantages of this configuration is the sacrifice that some of the full range uniformity but where two separate pipes are employed, the bass extension or in-phase driver can be loaded towards the wall to increase the bass by 3 db per pipe with the full range sound extended into the room acting as the point source. The same system can be also accomplished with a longer pipe but the electroacoustic phasing will not be as effective for delivery of deeper bass as it would in the smaller enclosure using generally standard type drivers.

Prior art speaker systems may be seen in the following U.S. patents. In the Ashe U.S. Pat. No. 2,905,259, a tubular speaker housing has a single loudspeaker mounted in the middle of two truncated cones attached to form one tube spreading in each direction. The Lanternier U.S. Pat. No. 4,905,788, shows an electro-acoustic transducer which uses a single hollow cylindrical support for an active speaker at one end and a passive radiator mounted at the opposite end thereof for increasing the bass response from the tube. Two systems are required for stereo response. In the Flanders U.S. Pat. No. 4,753,317, a trapezoidal loudspeaker enclosure mounts a loudspeaker at one end at an angle and passively at the other with attached base plates over each angled end of the enclosure. The Manger U.S. Pat. No. 4,268,719, is a loudspeaker arrangement giving a pair of back-to-back loudspeakers in an infinite baffle arrangement. The Seville U.S. Pat. No. 4,655,315, teaches a speaker system having a plurality of serially connected angularly disposed hollow tubes with a loudspeaker mounted at one end, which tube can be adjusted to different shapes. The Virva U.S. Pat. No. 4,164,988, shows a fine tuned column speaker system in which a bellows is formed in part of tube or in which telescoping tubes can be adjusted for a single loudspeaker to vary the length of the back tube for the backwave of the speaker. The Robinson U.S. Pat. No. 3,945,461, is a sound speaker system which has an adjustable telescoping tube which can be locked in place and has a loudspeaker mounted facing the bottom of one of the tubes.

The aim of the present invention is to have a loudspeaker system with a single elongated hollow tube which may be a rigid tube or a telescoping tube with a wide range speaker mounted in each end thereof and the tube length set to accomplish the desired affect in both the wide range sound and increased bass response and also to utilize positioned end deflectors for directing the sound.

SUMMARY OF THE INVENTION

A loudspeaker apparatus includes an elongated hollow tube having two open ends, which tube may be a rigid or telescoping tube, and has a wide range speaker mounted at each end of the hollow tube. A pair of deflector surfaces may be flat, polymer surfaces mounted to a base and are positioned at an angle facing each speaker at each end of the tube for deflecting the sound waves emanating from each speaker in accordance with the positioning of the tube. The tube may also have a tuned port formed into the side of the tube and connected to an arcuate passageway built into the hollow portion of the inside of the tube for producing a bass resonance from the backwaves of both speakers.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
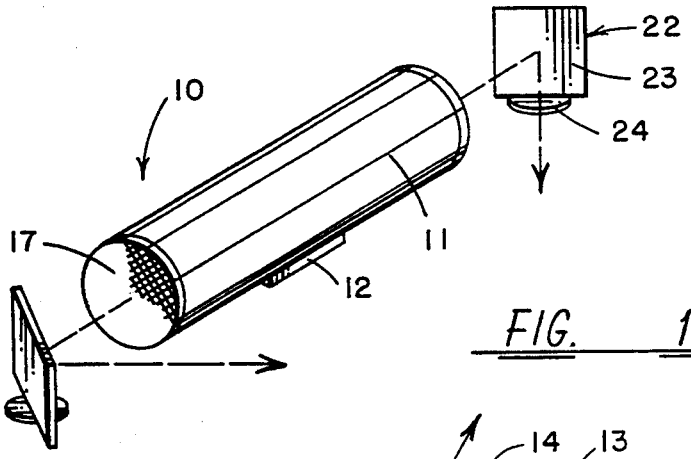
FIG. 1 is a perspective view of a sound system in accordance with the present invention.
Figure 2:
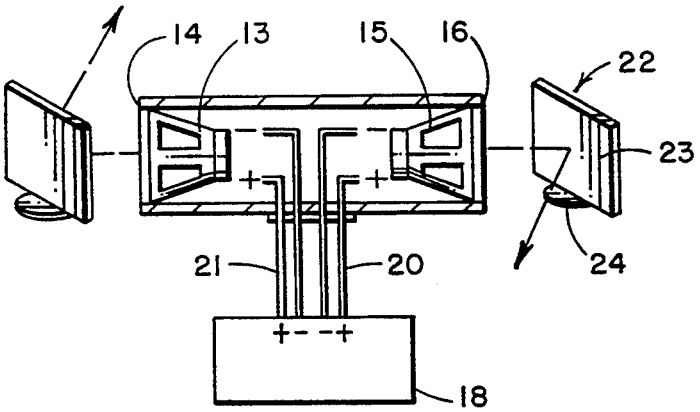
FIG. 2 is a sectional view of the sound system tube of FIG. 1 interconnected with a sound source.

Referring to the drawings and especially to FIGS. 1 and 2, a sound system 10 is illustrated having a rigid tube 11 which can be made of a polymer or even of a paperboard, if desired, and is made of a predetermined length and sits on a flat base member 12 which prevents the tube from rolling but which base member can also be used for attaching the tube to a wall or the like. Tube 11 has a full range speaker 13 mounted in one end 14 thereof and a full range speaker 15 mounted in the second end 16 of the tube 11 as far apart as possible with the length of tube, each speaker has a speaker grill 17 covering the front of the speakers 13 and 15. Speakers 13 & 15 both are directed to emanate directly from the outside of the tube 180° from each other. The tube, as illustrated in FIGS. 1 and 2, is a rigid tube which has been carefully calculated as to length in which the two drivers 13 and 15 are set out-of-phase with each other in the small container to increase the lower frequency sound pressure level in each in a push-pull arrangement and will not hurt the stereo affect and upper range output of the drivers 13 and 15. A sound source 18 may include a stereo amplifier receiver and may receive a sound input from a CD player or the like which is conducted through the conductors 20 to the stereo speaker driver 15 and through the conductors 21 to the driver 13. The drivers 13 and 15 are carefully placed at the furthest point from each end 14 and 16 thereof and are faced back-to-back aligned on the center axis of the tube 11 so that the audio energy emanates from the front of each driver 13 and 15 and from each end of the tube.

The audio output energy is controlled by a pair of audio deflectors 22, each having a plate 23 for deflecting the energy, which is illustrated as a flat plate but also can be a shaped arcuate plate, if desired, and each defector surface 23 is mounted to a base 24 which allows it to stand up right on a surface and to be aligned at any angle desired depending upon the placement of the tube 11 resting on its base 12. For instance, a different angle is shown in FIGS. 1 and 2 which deflects the energy at an opposite angle from each end. It should be clear that the deflector surface 23 can be rotated 360° and thus has variations of angles over 180°.

The enclosure pipe section 11 is set to be a minimum of twice the length of the radius of the drivers 13 and 15 and each drive is selected to be equal in character, size, shape and general electro-acoustical response to the other. In addition, it will be clear that a dual mono source input can also be utilized within the sound system. The system allows a very small sound system incorporated into one enclosure which can produce a full range of audio output and which can vary the sound stage for a stereo system and which can be made in a very small size.

Figure 3:
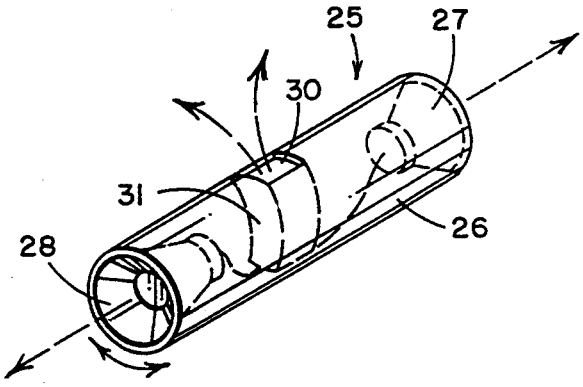
FIG. 3 is an alternate embodiment of a sound system in accordance with FIGS. 1 and 2 having a tuned port formed therein.

Turning to FIG. 3, a second embodiment of the sound system 25 is illustrated having a rigid tube 26 having an audio driver 28 mounted in the other end thereof, which are both full range drivers in accordance with the embodiments of FIGS. 1 and 2. In this embodiment, an opening 30 within the rigid tube 26 is used to create an acoustic centerfield image, which opening is sized to at least half the radius of one of the drivers 27 or 28 and includes a passageway or length of tubing 31 which is arcuately shaped to follow the wall of the rigid pipe 26. The pipe 31 is the same length as the diameter of the hole 30 and is set to produce a tuned helmholtz or small theile signal to produce an acoustical centerfield for the system 25.

Figure 4:
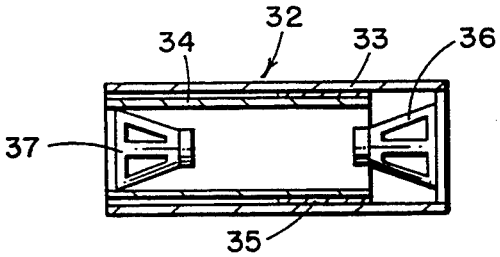
FIG. 4 is another embodiment of a loudspeaker system having a pair of telescoping tubes in one position.
Figure 5:
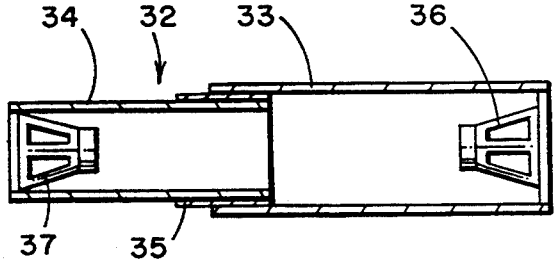
FIG. 5 is a sectional view of the embodiment of FIG. 4 having the tubes repositioned.

Turning to FIGS. 4 and 5, another embodiment 32 is illustrated having a rigid tube 33 acting as an outer telescoping tube and an inner telescoping rigid tube 34, which tubes 33 and 34 slid within each other. The sliding is adjusted by a pressure fit but can have with one of the tubes having raised thin ridges 35 to slightly space the tube 33 from the tube 34 to allow the escape of air pressure from between the two tubes. Tube 33 has an acoustical driver 36 mounted at one end thereof while tube 34 has an acoustical driver 37 mounted in the end thereof so that the tubes 33 and 34 act as one tube which can have the volume in the space 40 adjusted by telescoping the tubes in and out to a predetermined length in a predetermined internal volume for producing the best bass frequency. In addition, the tubes may or may not have the ridges 35 which allows the escape of air pressure from the backwave of the drivers 36 and 37 through the arcuate spacing formed by the ridges slightly spacing the tubes one from the other while maintaining a tight fit of the tubes to each other. It, of course, will be clear that a small screw or the like can lock the tubes together to any predetermined length without departing from the spirit and scope of the invention.

It should be clear at this point that a loudspeaker system has been provided which is easily incorporated into one enclosure for producing an improved sound output from a small enclosure are which can be easily placed and located and can easily have the sound directed for maximum benefit. For instance, the tube 11 can be placed in front of a television set or even mounted in the housing of a television to extend slightly from either side thereof and can be used in connection with computer monitors with very small amplified signals to produce sound in connection with computer programs and CD ROM drives or it can be made larger for incorporation into home sound systems. However, the present invention should not be construed as limited to the forms shown which are to be considered illustrative rather than restrictive.

I claim:

1. A loudspeaker system comprising:

an elongated hollow tube having two open ends;

a first wide range speaker mounted in one open end of said tube and facing outside said tube;

a second wide range speaker mounted in the other end of said tube and facing outside said tube;

a plurality of conductors coupled to said first and second wide range speakers through said elongated hollow tube for connecting said loudspeaker system to a sound source;

a pair of deflector surfaces, each having a supporting base member and each deflector surface being positioned in line with the axis of said elongated hollow tube in front of one of said wide range loudspeakers, whereby a sound system is contained in a single tube, wherein said elongated hollow tube is formed of a pair of telescoping tubes for adjusting the volume in said elongated hollow tube.

2. A loudspeaker system in accordance with claim 1 in which said pair of telescoping tubes have a plurality of spacers formed on the surface of one said tube to thereby space one telescoping tube from the other and thereby allow the passage of air.

* * * * *